US006905697B2

(12) United States Patent
Baumöller et al.

(10) Patent No.: US 6,905,697 B2
(45) Date of Patent: Jun. 14, 2005

(54) LOTIONED FIBROUS WEB HAVING A SHORT WATER ABSORPTION TIME

(75) Inventors: Guido Baumöller, Leichlingen (DE); Rolf Kawa, Monheim (DE); Stephan Eichhorn, Gernsheim (DE); Roland Sporer, Korschenbroich (DE)

(73) Assignee: SCA Hygiene Products GmbH, Mannheim (DE)

( * ) Notice: Subject to any disclaimer, the term of this patent is extended or adjusted under 35 U.S.C. 154(b) by 79 days.

(21) Appl. No.: 10/051,529

(22) Filed: Jan. 22, 2002

(65) Prior Publication Data

US 2002/0146561 A1 Oct. 10, 2002

Related U.S. Application Data

(60) Provisional application No. 60/262,367, filed on Jan. 19, 2001.

(51) Int. Cl.[7] ..... A01N 25/34
(52) U.S. Cl. ..... 424/402; 514/846
(58) Field of Search ..... 424/402, 404

(56) References Cited

U.S. PATENT DOCUMENTS

| | | | |
|---|---|---|---|
| 1,127,438 A | 2/1915 | Holliday | |
| 2,122,716 A | 7/1938 | Graves | |
| 2,495,066 A | 1/1950 | Jones | |
| 3,264,188 A | 8/1966 | Gresham | |
| 3,305,392 A | 2/1967 | Britt | |
| 3,619,280 A | 11/1971 | Scheuer | |
| 3,814,096 A | 6/1974 | Weiss et al. | |
| 3,896,807 A | 7/1975 | Buchalter | |
| 4,112,167 A | 9/1978 | Dake et al. | |
| 4,202,879 A | 5/1980 | Shelton | |
| 4,462,981 A | 7/1984 | Smith | |
| 4,481,243 A | 11/1984 | Allen | |
| 4,513,051 A | 4/1985 | Lavash | |
| 4,550,035 A | 10/1985 | Smith | |
| 4,764,418 A | 8/1988 | Kuenn et al. | |
| 4,786,367 A | 11/1988 | Bogart et al. | |
| 4,824,689 A | 4/1989 | Kuenn et al. | |
| 4,950,545 A | 8/1990 | Walter et al. | |
| 4,987,632 A | 1/1991 | Rowe et al. | |
| 5,059,282 A | 10/1991 | Ampulski et al. | |
| 5,069,897 A | 12/1991 | Orr | |
| 5,215,626 A | 6/1993 | Ampulski et al. | |
| 5,240,562 A | 8/1993 | Phan et al. | |
| 5,312,522 A | 5/1994 | Van Phan et al. | |
| 5,334,388 A | 8/1994 | Hoang et al. | |
| 5,362,500 A | 11/1994 | Mazurek et al. | |
| 5,389,204 A | 2/1995 | Ampulski | |
| 5,397,435 A | 3/1995 | Ostendorf et al. | |
| 5,415,737 A | 5/1995 | Phan et al. | |
| 5,601,871 A | 2/1997 | Krzysik et al. | |
| 5,605,651 A | 2/1997 | Balzer | |
| 5,614,293 A | 3/1997 | Krzysik et al. | |
| 5,650,218 A | 7/1997 | Krzysik et al. | |
| 5,665,426 A | 9/1997 | Krzysik et al. | |
| 5,720,966 A | 2/1998 | Ostendorf | |
| 5,840,943 A | 11/1998 | Ansmann et al. | |
| 5,871,763 A * | 2/1999 | Luu et al. | 424/402 |
| 5,885,697 A | 3/1999 | Krzysik et al. | |
| 6,576,678 B1 | 6/2003 | Bruening et al. | |
| 6,596,779 B1 | 7/2003 | Jean-Noel et al. | |

FOREIGN PATENT DOCUMENTS

| | | |
|---|---|---|
| DE | 485 947 | 11/1929 |
| DE | 490 263 | 1/1930 |
| DE | 1 814 558 | 6/1970 |
| DE | 20 24 051 | 12/1971 |
| DE | 2 129 441 | 12/1972 |
| DE | 34 47 499 A1 | 7/1986 |
| DE | 39 24 898 A1 | 1/1991 |
| DE | 198 25 462 A1 | 12/1999 |
| DE | 198 28 081 | 12/1999 |
| DE | 198 43 876 A1 | 4/2000 |
| DE | 199 06 081 A1 * | 8/2000 |
| EP | 0 033 448 A1 | 8/1981 |
| EP | 0 049 354 A2 | 4/1982 |
| EP | 0 186 208 B1 | 7/1986 |
| EP | 0 211 773 A2 | 2/1987 |
| EP | 0 347 153 A2 | 12/1989 |
| EP | 0 347 154 A2 | 12/1989 |
| EP | 0 347 176 A2 | 12/1989 |
| EP | 0 347 177 A2 | 12/1989 |
| EP | 0 350 275 A2 | 1/1990 |
| EP | 0 759 291 A1 | 2/1997 |
| EP | 0 766 661 | 4/1997 |
| EP | 0 803 012 B1 | 10/1997 |
| EP | 0 938 886 A2 | 9/1999 |
| EP | 0 950 705 A1 | 10/1999 |
| EP | 1 027 921 | 8/2000 |
| EP | 1 029 977 A1 | 8/2000 |
| GB | 1 333 475 | 10/1973 |
| GB | 1 424 692 | 2/1976 |

(Continued)

OTHER PUBLICATIONS

Cosmetics: Science and Technology, Second Edition, vol. 1, Wiley–Interscience, Bd. 1, 1972, pp. 27–104.
Abbas Alli G. Shaikh, "Organic Carbonates", Chem. Rev., 1996, vol. 96, No. 3, pp. 951–976.
3. edition of "Leitfadens zur Inhaltsstoffdeklaration Kosmetischer Mittel (guidelines for the nomenclature of ingredients in cosmetic agents) herausgegeben vom (edited by) Industrieverband Korperpflege– und Wachmittel e.V. (IKW), Frankfurt", pp. 44–62.
Kirk–Othmer, "Encyclopedia of Chemical Technology", Third Edition, Wiley–Interscience, vol. 8., 1979, pp. 913–915.

*Primary Examiner*—Thurman K. Page
*Assistant Examiner*—Sharon Howard
(74) *Attorney, Agent, or Firm*—Young & Thompson

(57) ABSTRACT

A fibrous web, in particular tissue web treated with a lotion composition based on an O/W emulsion comprising: (A) at least one oil; (B) an (O/W) emulsifier or (O/W) emulsifier combination; and (C) 6 to 30 weight % of water; wherein the weight % values relate to the total weight of the lotion composition. Since in the above lotion composition the external phase is aqueous, a web treated therewith can easily be wet by water and does not float on the water if it is to be disposed in a toilet.

10 Claims, 1 Drawing Sheet

FOREIGN PATENT DOCUMENTS

Figure 1:
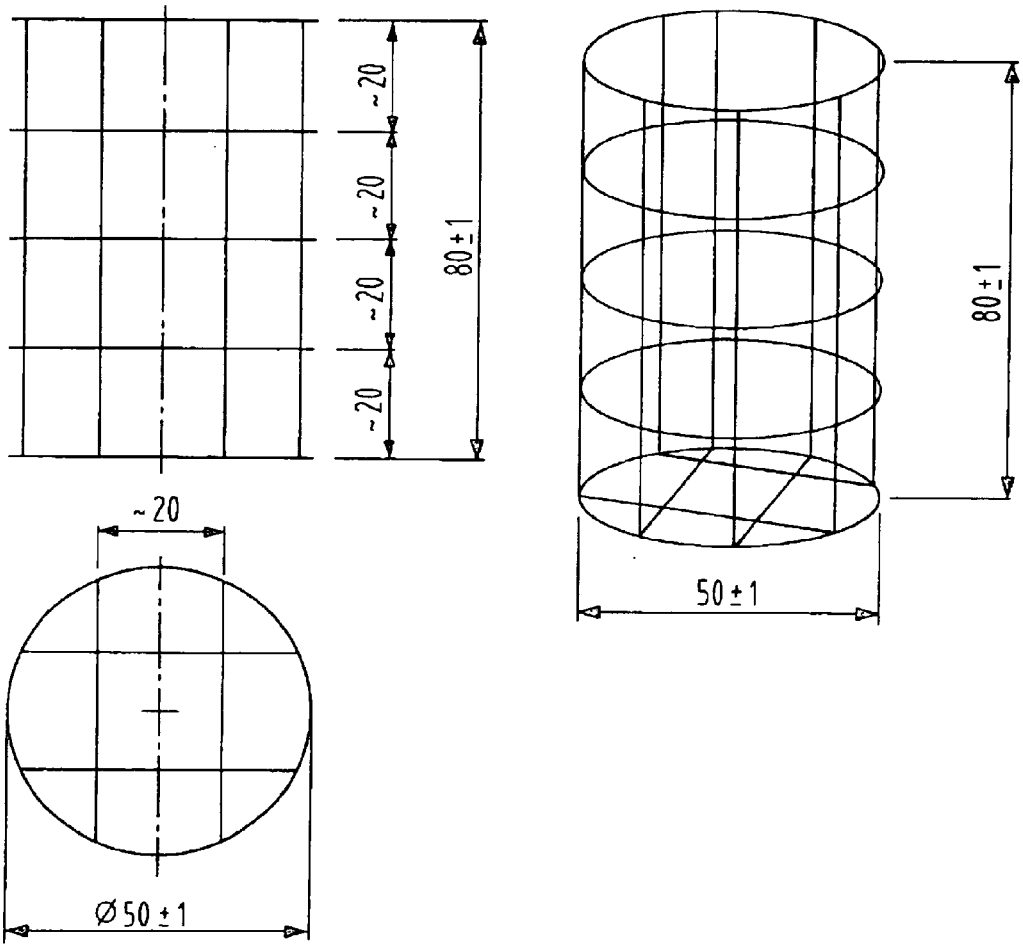

| | | | |
|---|---|---|---|
| GB | 2 033 751 | A | 5/1980 |
| GB | 2 066 661 | A | 7/1981 |
| GB | 2 069 333 | A | 8/1981 |
| GB | 2 103 089 | A | 2/1983 |
| JP | 59 144 426 | A2 | 8/1984 |
| JP | 61 289 016 | | 12/1986 |
| JP | 62-87117 | | 4/1987 |
| JP | 01 093 506 | A2 | 4/1989 |
| JP | 02 032 011 | A2 | 2/1990 |
| JP | 02 104 511 | A2 | 4/1990 |
| JP | 04 005 224 | A2 | 1/1992 |
| JP | 4 009 121 | A | 1/1992 |
| JP | 5-156596 | | 6/1993 |
| JP | 07 002 615 | A2 | 1/1995 |
| JP | 08 196 461 | A2 | 8/1996 |
| JP | 10 023 988 | A2 | 1/1998 |
| JP | 10 226 986 | A | 8/1998 |
| WO | WO 93/02252 | | 2/1993 |
| WO | WO 94/05856 | | 3/1994 |
| WO | WO 94/05857 | | 3/1994 |
| WO | WO 94/26971 | | 11/1994 |
| WO | WO 94/26974 | | 11/1994 |
| WO | WO 95/16824 | | 6/1995 |
| WO | WO 95/35411 | | 12/1995 |
| WO | WO 95/35412 | | 12/1995 |
| WO | WO 96/08601 | | 3/1996 |
| WO | WO 96/14835 | | 5/1996 |
| WO | WO 96/24329 | | 8/1996 |
| WO | WO 96/24719 | | 8/1996 |
| WO | WO 96/25557 | | 8/1996 |
| WO | WO 96/34035 | | 10/1996 |
| WO | WO 97/03645 | | 2/1997 |
| WO | WO 97/04171 | | 2/1997 |
| WO | WO 97/06306 | | 2/1997 |
| WO | WO 97/06307 | | 2/1997 |
| WO | WO 97/30216 | | 8/1997 |
| WO | WO 97/30217 | | 8/1997 |
| WO | WO 97/40814 | | 11/1997 |
| WO | WO 97/40815 | | 11/1997 |
| WO | WO 97/46205 | | 12/1997 |
| WO | WO 98/29602 | | 7/1998 |
| WO | WO 98/29605 | | 7/1998 |
| WO | WO 98/41687 | | 9/1998 |
| WO | WO 99/05246 | | 2/1999 |
| WO | WO 99/08555 | | 2/1999 |
| WO | WO 99/12519 | | 3/1999 |
| WO | WO 99/13861 | | 3/1999 |
| WO | WO 99/25318 | | 5/1999 |
| WO | WO 99/39682 | | 8/1999 |
| WO | WO 99/45771 | | 9/1999 |
| WO | WO 00/04230 | | 1/2000 |
| WO | WO 00/64407 | | 11/2000 |
| WO | WO 00/64408 | | 11/2000 |
| WO | WO 00/64409 | | 11/2000 |

* cited by examiner

LOTIONED FIBROUS WEB HAVING A SHORT WATER ABSORPTION TIME

FIELD OF INVENTION

The invention relates to a soft lotioned fibrous web, in particular tissue paper which easily sinks in water due to a specific lotion based on an oil-in-water emulsion.

BACKGROUND ART

Based on the underlying compatibility of the production processes (wet laying), "tissue" production is counted among the paper making techniques. The production of tissue is distinguished from paper production by its extremely low basis weight of normally less than 65 g/m$^2$ and its much higher tensile energy absorption index. The tensile energy absorption index is arrived at from the tensile energy absorption in which the tensile energy absorption is related to the test sample volume before inspection (length, width, thickness of sample between the clamps before tensile load). Paper and tissue paper also differ in general with regard to the modulus of elasticity that characterizes the stress-strain properties of these planar products as a material parameter.

A tissue's high tensile energy absorption index results from the outer or inner creping. The former is produced by compression of the paper web adhering to a dry cylinder as a result of the action of a crepe doctor or in the latter instance as a result of a difference in speed between two wires ("fabrics"). In the latter technique, often referred to as "(wet) rush transfer", for instance the forming fabric of the paper machine is moved at greater speed than that of the fabric to which the formed paper web is transferred, for instance a transfer fabric or a TAD fabric (through air drying), so that the paper web is somewhat bundled when it is taken up by the transfer fabric. Many prior art documents (e.g. EP-A-0 617 164, WO-94/28244, U.S. Pat. No. 5,607,551, EP-A-0 677 612, WO-96/09435) refer to this as "inner creping", when they describe the production of "uncreped" tissue paper by rush transfer techniques. The inner and outer creping causes the still moist, plastically deformable paper web to be internally broken up by compression and shearing, thereby rendering it more stretchable under load than uncreped paper. Most of the functional properties typical of tissue and tissue products result from a high tensile energy absorption index (see DIN EN 12625-4 and DIN EN 12625-5).

Typical properties of tissue paper include the ready ability to absorb tensile stress energy, their drapability, good textile-like flexibility, a high specific volume with a perceptible thickness as high a liquid absorbency as possible and, depending on the application, a suitable wet and dry strength as well as an interesting visual appearance of the outer product surface.

Softness is an important property of tissue products such as handkerchiefs, cosmetic wipes, toilet paper, serviettes/napkins, not to mention hand or kitchen towels, and it describes a characteristic tactile sensation caused by the tissue product Upon contact with the skin.

Although the term "softness" is generally comprehensible, it is extremely difficult to define because there is no physical method of determination and consequently no recognized industrial standard for the classification of different degrees of softness.

To be able to detect softness at least semi-quantitatively, softness is determined in practice by means of a subjective method. To do so, use is made of a "panel test" in which several trained test persons give a comparative opinion.

In simplified terms, softness can be subdivided into its main characteristics, surface softness and bulk softness. Surface softness describes the feeling perceived when e.g. one's fingertips move lightly over the surface of the sheet of tissue. Bulk softness is defined as the sensory impression of the resistance to mechanical deformation that is produced by a tissue or tissue product manually deformed by crumpling or folding and/or by compression during the process of deformation.

One method for increasing bulk softness of tissue paper as taught by WO 96/25557 involves a) wet-laying an aqueous slurry containing cellulosic fibres to form a web b) applying a water soluble polyhydroxy compound to the wet web, and c) drying and creping the web (wet web addition method).

It is further known from U.S. Pat. No. 4,764,418 that some humectants such as polyethylene glycol contribute to the softness of tissue products if they are applied to a dry web.

The use of humectants, such as polyhydroxy compounds, in highly concentrated form, as softeners however, has the disadvantage that the humectant may, upon contact, draw too much moisture from the skin, for instance when blowing one's nose with a tissue handkerchief. Moreover the softening effect is not yet satisfactory.

WO 96/24723 teaches increasing the surface softness of tissue paper by applying discrete deposits of a water free lotion composition containing an oil and a wax. Since however, due to its solid consistency, the treatment composition remains on the surface of the tissue paper, it cannot contribute to bulk softness. Further, water-free lotion compositions based on waxy or oily materials often feel unpleasantly greasy or oily.

Moreover, water-free lotions such as the one in WO 96/24723 often do rot feel particularly pleasant to the skin.

EP A 1 029 977 relates to a composition for treating paper products, such as tissue products, comprising between 30 and 90% by weight of oil, between 1 and 40% by weight of wax, between 1 and 30% by weight of an emulsifying agent and between 5 and 35% by weight of water. These lotion compositions are based on W/O emulsions, are solid or semisolid at 30° C., and remain primarily at the surface of the tissue paper, although they penetrate the tissue paper somewhat more than the solid composition of WO 96/24723.

DE 199 06 081 A1 discloses emulsions containing (a) 5 to 25% by weight polyol poly-12-hydroxy stearate, (b) 50 to 90% by weight waxy esters, and (c) 5 to 25% by weight waxes. This document further contains examples describing the treatment of tissue papers with W/O emulsions as defined above containing about 20 to 25% water. These compositions are solid or semisolid at 30° C. (Example 1 corresponds to lotion F of EP A 1 029 977) and demonstrate the same penetration behaviour as described above for the lotions of EP A 1 029 977.

However, tissue papers treated with water-in-oil (W/O) lotions often float on the Water for a longer time and cannot be flushed down, if they are to be disposed in a toilet. This is a serious disadvantage, in particular for lotioned toilet papers which are becoming increasingly popular due to their softness and pleasant feel on the skin of the user.

WO 97/30216 discloses a softening lotion composition for treating tissue. The composition is aqueous and liquid, and includes as active ingredients (a) one or more saturated straight fatty alcohols having at least 16 C atoms in a preferred amount of 35 to 90% by weight, (b) one or more waxy esters having a total of at least 24 C atoms in a preferred amount of 1 to 50% by weight, (c) optionally non-ionic and/or amphoteric emulsifiers, preferably oil-in-water emulsifiers, and (d) optionally 0 to 50% mineral oil.

The lotion composition comprises 1 to 50% by weight active ingredients and consequently 50 to 99% by weight of water. According to the teaching of WO 97/30217, this aqueous composition is combined with a quaternary ammonium compound.

If such high water content lotions are applied to tissue paper, they can strongly affect the strength properties (dry strength or wet strength, if additional water, e.g. from body fluids is absorbed by the tissue paper).

Similar problems can occur if other fibrous web structures such as nonwoven are to be treated with lotions, in particular if they contain a major proportion of cellulosic fibres.

Thus, one object of the present invention involves providing a lotion-treated fibrous web, in particular nonwoven or tissue paper that overcomes the disadvantages of prior art formulations.

In a first aspect, the present invention is intended to provide a lotioned fibrous web which can be easily disposed of in a toilet, since it does not float on the water for long.

In a further aspect, the present invention seeks to provide a lotioned fibrous. web, the strength properties of which are not greatly deteriorated by the application of lotion.

One object of the present invention also involves providing a fibrous web treated with a lotion composition which remains stable while enhancing softness, in particular, bulk softness of the web.

A further technical object of the present invention is to provide a lotioned fibrous web which feels very pleasant to the skin and is not oily or greasy to the touch.

SUMMARY OF THE INVENTION

This technical object is solved by a fibrous web, in particular tissue paper treated with a lotion composition based on an O/W emulsion comprising (A) at least one oil, (B) an (O/W) emulsifier or (O/W) emulsifier combination, and (C) 6 to 30 weight % of water, wherein the weight % values relate to the total weight of the lotion composition.

Since in the above lotion composition the external phase is aqueous, a web treated therewith can be easily wet by water and therefore shows an excellent sinking behaviour in water. The water absorption time (measured according to prENV 12625-8, cf. item 5 below) preferably is less than 1 min, more preferably less than 30 sec, in particular less than 10 sec).

Further, the treated web feels pleasant to the skin and if necessary is capable of transferring active agents to the skin of the user.

FIGURE

FIG. 1 contains three aspects of the wire basket to be used in prENV 12625-8 (Determination of water absorption time).

DETAILED DESCRIPTION OF THE INVENTION

The lotioned fibrous web, in particular tissue paper of the invention is typically obtained by applying the aforementioned lotion composition to a dry fibrous web, in particular tissue web (without lotion). Preferably, the residual water content of the fibrous web, in particular tissue web is no sore than 10% by weight.

1. Lotion

By mixing and homogenizing oil, an (O/W) emulsifier or (O/W) emulsifier combination, an oil-in-water (O/W) emulsion is obtained.

The lotion composition can be a semi-solid or a viscous liquid at room temperature (23° C.).

In the first case, it typically has a viscosity of less than 30,000 mPa·s at 23° C. (measured with a Brookfield-RVF viscosimeter, spindle 5, 10 rpm). Thus, the lotion composition primarily remains on the surface of the fibrous substrate, contributing to surface softness of the product, and to a lesser extent to bulk softness.

In a preferred embodiment, the lotion has a fairly low viscosity in comparison to known semi-solid lotion compositions for tissues. This low viscosity contributes to an excellent penetration behaviour and prevents it from remaining on the surface of a fibrous web, in particular a single or multi-ply tissue product. In the case of single-ply webs such as single-ply tissues, it fully penetrates and softens the ply. In the case of multi-ply products, the lotion composition reaches the inner plies,greatly enhancing bulk softness. Such a low viscosity lotion preferably has a viscosity of less than 10,000 mPa·s at 23° C., a value typical of semi-solid lotions (measured with a Brookfield-RVF viscosimeter, spindle 5, 10 rpm; hereinafter viscosity values of the final lotion composition always relate to the measurement with a Brookfield-RVF viscosimeter, spindle 5, 10 rpm). Preferably, it has a viscosity of less than 7,500 mPa·s, more preferably 1,500 to 5,000 mPa·s, in particular, 2,000 to 3,500 mPa·s, measured at 23° C. Further, it is preferred that the viscosity at 30° C. ranges from 800 to 2,500 mPa·s in particular, 1,000 to 2,200 mPa·s. At a temperature of 40° C., preferred viscosity values are 500 to 1,500 mPa·s, in particular, 600 to 1,200 mPa·s. At 50° C., the low viscosity lotion preferably has a viscosity of less than 500, in particular less than 400 mPa·s.

The viscosity of the lotion can be adjusted, as known in the art, by the use of higher or lower amounts of solid components, in particular the consistency regulators mentioned below. Further the homogenization of the lotion (energy influx) may have an impact on the final viscosity. The melting range of the optionally present solid components, as measured according to DSC analysis of the final lotion composition, preferably lies within the temperature range of 25° to 70° C., in particular 30° to 60° C.

This lotion does not require the presence of silicone containing compounds, e.g. silicone oils or quaternary amine compounds in order to attain its softening effect, although their use is not excluded.

1.1 Oil Component (A)

The term "oil" is used for water-insoluble, organic, natural and synthetic, cosmetically useful oils having preferably a liquid consistency at room temperature (23°). The oil component preferably is used in a amount of 20 to 70 weight %, more preferably 30 to 65% by weight, in particular 40 (or 50) to 65% by weight. (Hereinafter, unless stated otherwise, weight % values always relate to the total weight of the lotion composition).

The oil component is suitably selected from among known oils from plant sources, mineral oils, or synthetic oils.

Preferably, the oil component (A) contains at least one oil selected from among the following types:

Glycerides, which are mono-, di- and/or tri ester (fatty acid ester) of glycerol (in particular di- and/or triester). Glycerides can be obtained by chemical synthesis or from natural sources (plant or animal) as known in the art. Preferably the fatty acid component has from 6 to 24, more preferably 6 to 18, in particular 8 to 18 carbon atoms. The fatty acid can be branched or unbranched as well as saturated or unsaturated. According to the invention the use of liquid glycerides from plant sources is preferred, in particular the use of a modified liquid coconut oil (INCI name; cocoglycerides, available under the trade name myritol® 331 from Cognis Deutschland GmbH) which contains as main component a mixture of di- and triglycerides based on C8 to C18 fatty acids.

Natural plant oils which also may contain liquid glycerides as main component such as soja oil, peanut oil, olive oil, sunflower oil macademia nut oil or jojoba oil.

Symmetric or asymmetric, linear or branched dialk(en)ylethers having from 6 to 24 carbon atoms (per alk(en)yl group, preferably having 12 to 24 C atoms as total number of C atoms), such as di-n-octylether (dicaprylylether), di-(2-ethylhexyl)ether, laurylmethylether, octylbutylether or didocecylether, the use of di-n-octylether (dicaprylylether; viscosity: 2–5 mPaS at 20° C., DGF method described below) being preferred.

Dialk(en)ylcarbonates having preferably at least one C6 to 22 alkyl or alkenyl group (preferred total number of C atoms: not more than 45 including the C atom for the carbonate unit). The alkyl or alkenyl group can be straight or branched. The alkenyl unit may display more than one double bond. These carbonates can be obtained by transesterification of dimethyl or diethyl carbonate in the presence of C6 to C22 fatty alcohols according to known methods (of. Chem. Rev. 96, 951 (1996)). Typical examples for dialk(en)ylcarbonates are the (partial) transesterification products of caprone alcohol, capryl alcohol, 2-ethylhexanol, n-decanol, lauryl alcohol, isotridecyl alcohol, myristyl alcohol, cetyl alcohol, palmoleyl alcohol, stearyl alcohol, isostearyl alcohol, oleyl alcohol, elaidyl alcohol, petroselinyl alcohol, linolyl alcohol, linolenyl alcohol, elaeostearyl alcohol, arachidyl alcohol, gadoleyl alcohol, behenyl alcohol, erucyl alcohol and brassidyl alcohol as well as their technical mixture, which are for instance obtained by high pressure hydrogenisation of technical methyl esters on fat or oil basis. Particularly suitable in view of their low viscosity at 20° C. are dihexyl-, dioctyl-, di-(2-ethylhexyl)- or dioleylcarbonat (viscosity of dioctylcarbonate: 7 mPaS at 20° C., DGF method described below). Thus it is preferred to use either short chain (C6 to C10) alkyl or alkenyl carbonates.

Hydrocarbon-based oils having preferably from 8 to 30, in particular 15 to 20 carbon atoms, such as squalane, squalene, paraffinic oils, isohexadecane, isoeicosane, polydecene or dialkycyclohexane, or mineral oil.

Waxy esters, preferably having the following generic formula (I)

$$R^1COO—R^2 \quad (I)$$

wherein $R^1CO$ represents a linear or branched acyl residue having 6 to 22 carbon atoms and 0, 1, 2, or 3 double bonds, and $R^2$ represents a linear or branched alkyl or alkenyl residue having 6 to 22 carbon atoms. Preferably, the total number of carbon atoms in the ester is at least 20. Typical examples of waxy esters are myristyl myristate, myristyl palmitate, myristyl stearate, nyristyl behenate, myristyl erucate, cetyl myristate, cetyl isostearate, cetyl oleate, cetyl behenate, cetyl erucate, stearyl mystrate, stearyl palmitate, strearyl stearate, stearyl isostearate, stearyl oleate, stearyl behenate, stearyl erucate, isosrearyl myristate, isostearyl palmitate, isostearyl stearate, isostearyl isostearate, isostearyl oleate, isostearyl behenate, oleyl myristate, oleyl palmitate, oleyl stearate, oleyl isostearate, oleyl oleate, oleyl behenate, oleyl erucate, behenyl myristate, behenyl palmitate, behenyl isostearate, behenyl oleate, behenyl behenate, behenyl erucate, erucyl myristate, erucyl palmitate, erucyl stearate, erucyl isostearate, erucyl oleate, erucyl behenate and erucyl erucate. Preferably, unsaturated waxy esters, such as oleyl oleate and oleyl erucate are used.

The following esters, which due to similar properties, are also counted among the "waxy esters": esters derived from linear $C_6$–$C_{22}$ fatty acids and branched-chain alcohols, e.g. 2-ethyl hexanol; ester of C18–C38-alkyl hydroxy carboxylic acids and linear or branched $C_6$–$C_{22}$ fatty alcohols; or ester of linear and/or branched fatty acids and polyhydric alcohols (such as propylene glycol, dimerdiol or trimertriol) and/or guerbet alcohols, as well as ester of $C_6$–$C_{22}$ fatty alcohols arid/or guerbet alcohols with aromatic carboxylic acids, in particular benzoic acid; ester of $C_2$–$C_{12}$ dicarboxylic acids and linear or branched alcohols having 1 to 22 carbon atoms or polyols having 2 to 10 carbon atoms and 2 to 6 hydroxy groups, in particular dioctyl malate.

Cosmetically useful silicone oils (e.g. those of U.S. Pat. No. 4,202,879 and U.S. Pat. No. 5,069,897).

Further, the oil component is preferably selected (depending on chain length or esterification degree as known from the prior art) such that its polarity is not greater than 5, in particular not greater than 4 Debey.

In further preferred embodiment, the oil component is suitably selected among low viscosity oils, i.e. oils having a viscosity of 1–100 mPa·s, in particular 1–50 mPa·s (e.g. 1–20 mPaS) measured with a Höppler falling sphere viscosimeter at 20° C. (method "Deutsche Gesellschaft für Fettchemie" DGF C-IV 7), in order to achieve the desired penetration behaviour on the web, in particular on tissue.

If a deeper penetration of the web by the lotion is desired, it is preferred that the oil component (A) comprise (preferably at least 20% by weight, in particular at least 40% by weight, based on the oil component) at least one "oil (A')" which is preferably selected from oils having a viscosity lower than 30 mPa·s measured with a Höppler falling sphere viscosimeter at 20° C. (method DGF C-IV 7), and/or from symmetric or asymmetric dialk(en)ylethers having from 6 to 24 C atoms (per alkyl group) and preferably 12 to 24 C atoms in total, or linear or branched dialk(en)ylcarbonates derived from C 6 to 22 fatty alcohols. The viscosity of the oils is preferably less than 20, more preferably less than 15, in particular less than 10 mPa·s measured as above.

In a further preferred embodiment the oil component (A) comprises (preferably at least 20% by weight, in particular at least 40% by weight, based on the oil component) at least one "oil (A")", preferably having a viscosity greater than oil (A'), in particular greater than 30 mPa·s (preferably at least 40) and not snore than 100 mPa·s measured with a Höppler falling sphere viscosimeter at 20° C. (method DGF C-IV 7), and/or being at least one oil (A") selected from waxy esters, glycerides, natural oils and hydrocarbon based oils.

It is preferred to use the oils (A') and (A") in combination, in particular a mixture of (A') dialk(en)ylethers or dialk(en)ylcarbonates and (A"), waxy esters, glycerides, hydrocarbon-based oils or natural oils. The use or dialk(en)ylcarbonates and glycerides in combination is particularly preferred.

If one of these oils is used as part of the oil component (A), its weight proportion preferably is at least 20% by weight, in particular at least 40% by weight based on the total amount of the oil component.

In a particularly preferred embodiment, the oil component (A) comprises 20 to 80% in particular 40 to 60% by weight of a liquid glyceride and 80 to 20% by weight, in particular, 60 to 40% by weight of a liquid dialk(en)ylcarbonate.

1.2. O/W Emulsifier

The emulsifier or emulsifier composition (B) is preferably of a non-ionic type and primarily has the function of forming an oil-in-water emulsion. It can also contribute to the softness of tissue paper. It can be suitably selected from known O/W emulsifiers or combination thereof.

The emulsifier (combination) can be relatively polar and may for instance be selected from surfactants having a HLB value of 10 to 18. Such surfactants are known from the prior art and are, for instance, enumerated in Kirk-Othmer, *Enclypedia of Chemical Technology*, third edition, 1979, volume 8, page 913. In the case of ethoxylated products, the HLB value can be calculated according to the formula HLB=(100–L):5, where L is the weight proportion of lipophilic groups, e.g. the fatty alkyl of fatty acyl groups.

It is also possible to combine less polar and strongly polar emulsifiers such as the polyol poly(hydroxyesters) (B") and the alkyl(oligo)glycosides (B') described below. Expressed in terms of HLB value, a combination of surfactants having HLB values of 2.5 to 5 and 15 to 18 is also an embodiment of the invention.

The content of the (O/W) emulsifier (combination) is preferably 3 to 40% by weight, more preferably 5 to 30, in particular 7 to 20, e.g. 8 to 15% by weight.

Preferably, a liquid O/W emulsifier is used, although the use of minor amounts of solid emulsifier is possible depending on the desired viscosity of the resulting lotion composition.

Component (B) can be suitably selected from:

ethylenoxide or propylenoxide adducts of fatty alcohols having from 8 to 24 C atoms (in particular 12 to 22 C atoms), (C8–C15 alkyl)-phenol or polyols, containing 2 to 50 mol ethylenozy and/or 0 to 5 mol propylenoxy units.

Mono- or diesters (or mixtures thereof) derived from glycerol, poly-, oligo- or monosaccharides, sugar alcohols or sugar alcohol anhydrides (such as sorbitan), and linear or branched, saturated or unsaturated fatty acids having preferably 6 to 22 carbon atoms. These esters may also be ethoxylated (→ EO units), e.g. polysorbate monolaurate +20 EO or polysorbate mono-oleate +20 EO. If the ester is to be liquid, the fatty acid can often be selected from short chain saturated fatty acid, e.g. as in sorbitan monolaurate or from fatty acids having at least one unsaturated fatty acid, as in sobitan sesquioleate.

An alkyl(oligo)glycoside (referred to as B' in the claims) which is a nonionic surfactant wherein at least one hydroxy group (typically the C1 hydroxy of the first glycosyl) of an (oligo)glycoside is linked via at least one ether bond (or ethyleneoxi and/or propyleneoxi units) with an alkyl group-bearing unit (preferably 6 to 28 C atoms in total). The alkyl(oligo) glycoside preferably has the following generic structure (II):

$$R^2O(C_nH_{2n}O)_t(\text{glycosyl})_x \qquad \text{(II)}$$

wherein $R^2$ is selected from the group consisting of alkyl, alkylphenyl, hydroxyalkyl, hydroxyalkylphenyl, and mixtures thereof in which the alkyl group contains from 6 to 22 carbon atoms, in particular from 8 to 16 carbon (e.g. 10 to 14 carbon atoms); n is 2 or 3, preferably 2, t is from 0 to about 10, preferably 0; x is at least 1, preferably from 1.1 to 5, more preferably 1.1 to 1.6, in particular 1.1 to 1.4, and "glycosyl" is a monosaccharide. The x value is to be understood as the average content of monosaccharide units (oligomerization degree).

The production of alkyl(oligo)glycoside useful in the present invention is known from the prior art and described, for instance in U.S. Pat. Nos. 4,011,389, 3,598,865, 3,721,633, 3,772,269, 3,640,998, 3,839,318, or 4,223,129.

To prepare these compounds, the alcohol or alkylpolyethoxy alcohol is typically first formed and then reacted with the (oligo)glycosyl unit to form the (oligo)glycoside (attachment at the 1-position). The glycosyl units can be attached between the C1 position of further glycosyl(s) and the alkyl-group-bearing glycosyl unit's 2-, 3-, 4- and/or 6-position, preferably 6-position.

Preferred starting alcohols $R^2OH$ are primary linear alcohols or primary alcohols having a 2-methyl branch. Preferred alkyl residues $R^2$ are for instance 1-octyl, 1-decyl, 1-lauryl, 1-myristyl, 1-cetyl, and 1-stearyl, the use of 1-octyl, 1-decyl, 1-lauryl, and 1-myristyl being particularly preferred.

Alkyl(oligo)glycosides useful in the invention may contain only one specific alkyl residu. Usually, the starting alcohols are produced from natural fats, oils or mineral oils. In this case, the starting alcohols represent mixtures of various alkyl residues.

In four specific (preferred) embodiments alkyl(oligo)glycosides are used, wherein $R^2$ consists essentially of C8 and C10alkyl groups, C12 and C14 alkyl groups, C8 to C16 alkyl groups, or C12 to C16 alkyl groups.

It is possible to use as sugar residue "(glycosyl)x" any mono- or oligosaccharide. Usually, sugars having 5 or 6 carbon atoms as well as the corresponding oligosaccharides are used. Such sugars include, for instance glucose, fructose, galactose, arabinose, ribose, xylose, lyxose, allose, altrose, mannose, gulose, idose, talose and sucrose. It is preferred to use glucose, fructose, galactose, arabinose, sucrose as well as their oligosaccharides, (oligo)glucose being particularly preferred.

In a preferred embodiment "laurylglucoside", a C12–C16 fatty alcohol-glucoside (x=1.4), which can be obtained from Cognis Deutschland GmbH under the tradename Plantacare®, is used.

Combinations thereof.

It is preferred to use a combination of the emulsifier (B') and (B") described below, (B"): a liquid polyol polyester wherein a polyol having at least two hydroxy groups is esterified with at least one carboxylic acid having front 6 to 30 carbon atoms (in particular 16 to 22 C atoms) and having at least one hydroxy group or condensation products of this hydroxy fatty acid. Polyols include monosaccharides, disaccharides, and trisaccharides, sugar alcohols, other sugar derivatives, glycerol, and polyglycerols, e.g. diglycerol, triglycerol, and higher glycerols. Such polyol preferably has from 3 to 12, in particular 3 to 8 hydroxy groups and 2 to 12 carbon atoms (on average, if it is a mixture as in polyglycerols). The polyol preferably is polyglycerol, in particular that having the specific oligomer distribution described in WO 95/34528 (page 5).

The carboxylic acid used in the polyol polyester preferably is a fatty acid having from 6 to 30 carbon atoms (Hereinafter, unless stated otherwise, the term "fatty acid" is not limited to the naturally occurring even-numbered, saturated or unsaturated long-chain carboxylic acids, but also includes their uneven-numbered homologues or branched derivatives thereof). The fatty acid contains at least one hydroxy group. It can be a mixture of hydroxy fatty acids or a condensation product thereof (poly(hydroxy fatty acids)). The preferred carbon range for the above mentioned hydroxy fatty acid is from 16 to 22, in particular 16 to 18. A particularly preferred poly(hydroxy fatty acid) is the condensation product of hydroxy stearic acid, in particular 12-hydroxy stearic acid, optionally in admixture with poly (ricinoleic acid), said condensation product having the properties described in WO 95/34528.

Preferred emulsifiers include the polyol poly (hydroxystearates) described in WO 95/34528, in particular polyglycerol poly(hydroxystearates) having the characteristics disclosed in this document, e.g. polyglycerol poly (12-hydroxy stearate), being available from Cognis Deutschland GmbH under the tradename Dehymuls® PGPH.

Preferred amounts of (B') are 1 to 15% by weight, in particular 3 to 8% by weight. Preferred amounts of (B") are 2 to 15% by weight, in particular 3 to 9% by weight.

The weight ratio of B' to B" preferably ranges from 0,2 to 2,0, more preferably from 0.5 to 1.5, in particular from 0.8 to 1.2.

1.3. Water

The lotion composition contains 6 to 35% by weight, more preferably 12 to 30% by weight, in particular 15 to 25% by weight of water. The water contributes to a lotion-like pleasant feel to the skin of the user. Water, further, counteracts the tendency of pure humectants (if present) to withdraw water from the human skin. On the other hand, the water content should not be much higher than 35% by weight, since then the mechanical strength of the treated tissue paper may Buffer to an undesired extent, Usually, the aqueous phase of the O/W emulsion contains water as a main component. However, if the water content is closer to the lower limit of the claimed range, it is preferred to add a corresponding amount of water-soluble, aqueous phase-forming components, preferably the humectant, to the lotion composition. Otherwise the discontinuous (oil) phase could be in too close contact, in order to maintain a stable O/W emulsion. In view of the above, the weight proportion of the aqueous phase is preferably more than 20, more preferably at least 22, in particular at least 23, or at least 24 weight %, based on the total weight of the lotion composition.

It is possible to determine the water content in the lotion composition by conducting a water determination according to Karl Fischer. This may also be done with the treated tissue paper. Thus, the entire lotion is extracted with suitable organic solvents (e.g. water-free ethanol), followed by the water determination of the ethanol extract according to Karl Fischer. If necessary, the residual water content of the treated tissue paper is to be subtracted.

1.4. Humectant (Optional)

The lotion composition preferably comprises from 1 to 15% by weight, and in particular 3 to 8% by weight (water-soluble) humectant.

The humectant performs multiple functions. First, it binds water and counteracts the tendency of water to evaporate. Moreover, the humectant can interact with other lotion components and then contributes to the softness of the tissue paper, in particular its bulk softness. The humectant can also influence the rheological properties of the lotion composition.

The humectant preferably is a polyhydroxy compound, which is understood to be an organic compound having at least two hydroxy groups and which preferably consists only of carbon, hydrogen, oxygen and nitrogen, in particular only of C, H and O. It is further desirable that the humectant is not ionic.

Although hydrophilic surfactants (having a HLB number of 10 or greater, see for instance U.S. Pat. No. 4,764,418) can have humectant properties, it is preferred according to the invention that the humectant be free of major hydrophobic molecule parts, e.g. fatty acid or fatty alcohol residues.

Further, the humectant preferably has a liquid consistency, even though it is possible to use a minor amount of a solid, low melting point humectant depending on the desired viscosity and penetration behaviour of the final lotion.

If liquid humectants are to be employed, the molecular weight (weight average) preferably is less than 1,000, more preferably less than 800, and in particular not more than 600.

Examples of suitable humectants include: glycerol, polyalkylene glycols, e.g. polyethylene glycol or polypropylene glycol, for instance polyethylene glycol having a weight average molecular weight of from about 200 to 600; neopentyl alcohols such as pentaerythritol or neopentyl glycol; sugar alcohols such as threitol, erythritol, adonitol (ribitol), arabitol, xylitol, dulcitol, mannitol and sorbitol, carbohydrates such as D(+)-glucose, D(+)-fructose, D(+)-galactose, D(+)-mannose, L-gulose, saccharose, galactose, maltose, polyglycerols, polyoxypropylene adducts of glycerol, methoxypolyethylene glycol, polyethylene glycol ethers of sugar alcohols, such as sorbitol, polyethylene glycol ethers of glycerol, and combinations thereof. Hyaluronic acid may also be used as humectant.

One preferred humectant is glycerol.

1.5. Coemulsifier (optional)

In a further embodiment, the lotion composition contains a coemulsifier in an amount of up to 15% by weight, more preferably 1 to 10% by weight and in particular 3 to 8% by weight, based on the total amount of the lotion composition. In order to stabilize the O/W emulsion, it is preferred to employ nonionic coemulsifiers, which are excellent in regard to their ecotoxicological properties and mild feel on the skin. However, the use of ampholytic surfactants (having a C8–C18-alkyl or -acyl group, at least one free amino group and at least one COOH or —$SO_3H$-group in the molecule and being capable of forming inner salts), zwitterionic surfactants (having in the molecule at least one quaternary ammonium group and at least one $COO^-$ or —$SO^-_3$ group), anionic surfactants (having an anionic group such as carboxylate, sulphate, sulphonate or phosphate rendering the surfactant water-soluble and a lipophilic residue) and cationionic surfacts (such as quaternary ammonium compounds) is also possible, though not preferred.

The coemulsifier is preferably selected from the group of lipophilic nonionic surfactants having a HLB value of 10 to 18. Such surfactants are known in the art and are, for instance, enumerated in Kirk-Othmer, *Enclypedia Of Chemical Technology*, third edition, 1979, volume 8, page 913. In the case of ethoxylated products, the HLB value can be calculated according to the formula HLB=(100−L):5, wherein L is the weight proportion of lipophilic groups, e.g. the fatty alkyl of fatty acyl groups.

The combined use of the nonionic O/W emulifier(s) (B) and the coemulsifier can lead to very finely dipersed emulsions, thus increasing the stability of the lotion compositon.

The coemulsifier may for instance be selected from:

Mixed esters obtainable by esterifying a) at least one fatty acid having 6 to 30, preferably 6 to 22 carbon atoms, such as coconut oil acids, b) a neopentyl alcohol such as neopentylglycol, dimethylolpropane, or preferably pentaerythritol c) at least one fatty alcohol having a carbon number of 6 to 30 carbon atoms, preferably 16 to 20 carbon atoms, such as stearic alcohol, and d) a tricarboxylic acid having no more than 10 carbon atoms and preferably at least one hydroxy group such as citric acid, preferably those of DE-A-11 65 574, e.g. Dicocoyl pentaerythrityl distearyl citrate, which is a solid.

ethoxylated castor oil and/or ethoxylated hardened castor oil displaying on average 7–60 mol or 2–15 mol ethylenoxi units.

Wool wax alcohols and combinations thereof.

The above optional components can be used in amounts of 1.5 to 7.5% by weight e.g. 3.5 to 5% by weight, based on the total weight of the lotion composition.

1.6. Consistency Regulators (Optional)

The viscosity of a lotion can be adjusted by using a corresponding amount of consistency regulators, which are typically solid. Hereinafter as well as above, the term "solid" or "liquid" refers to the physical state at room temperature (23° C.).

The amount of consistency regulators depends on the desired viscosity of the final lotion composition. If a semi-solid consistency is to be obtained, the consistency regulators can be used in amounts of up to 30% by weight, for instance 5 to 20% by weight.

On the other hand, if it is intended to produce a low viscosity lotion composition which fully penetrates the fibrous web, lower amounts of consistency regulators should be used. In this case, the overall content of solid components, including the consistency regulators is preferably less than 15% by weight, more preferably less than 10% by weight, in particular less than 5% by weight.

The consistency regulator is suitably selected from solid, mono-, di- and triglycerides and mixtures thereof, solid fatty alcohols, waxes, as well as metal soaps. Preferred embodiments thereof are explained in the following:

Glycerides are preferably the mono-, di- and/or triester of glycerol and fatty acids having from 6 to 30, in particular, 16 to 30 carbon atoms, whereby the term "fatty acid" is not restricted to the naturally occurring even-numbered, saturated and unsaturated carboxylic acids, but also includes their uneven-numbered homologues and isomers thereof. A skilled person can suitably select among known glycerides those having a solid consistency at 23° C., whereby the degree of esterification and unsaturation plays an important role. Usually, it is preferred to use glycerides wherein the fatty acid residues are predominantly saturated. In a more preferred embodiment, commercial mono-, di- and/or triglyceride (mixtures) are used, which are available from Cognis Deutschland GmbH under the tradenames Cutina® GMS or MD, or Novata® AB. Syncrowax® HGLC (available from Croda) may also be used. Particularly preferred is a glyceryl stearate (predominantly mono- and diester, some triester), which is marketed by Cognis Deutschland GmbH under the tradename Cutina® MD.

Metal Soaps:

A metal soap of the following formula may be used:

$$(R^1COO)_n\text{-}X$$

wherein $R^1$ represents a linear, saturated, or unsaturated acyl residue having 6 to 22 carbon atoms and optionally at least one hydroxy group, preferably 12 to 18 carbon atoms, X is an alkali metal (e.g. Li), earth alkali metal (e.g. Ca, Mg), or Al or Zn, and n is the valence of X. Preferred examples of the metal soap involve zinc, calcium, magnesium or aluminium stearate.

Wax:

The term "wax" is used as in the prior art for natural or synthetic materials which have a kneadable, solid or brittle consistency at room temperature, are finely to granularly crystalline, however not glass-like, and transparent to opaque. Useful waxes melt at a temperature above 35° C. without decomposition and then (slightly above the melting point) have a fairly low viscosity (sometimes referred to as "lipophilic" waxes). Useful waxes are listed in DE-A 199 06 081.

Fatty Alcohols:

Preferred fatty alcohols are those having at least 12, preferably 12 to 30 C atoms (e.g, C12–C24 or C24–C30), in particular the saturated embodiments thereof. Examples thereof involve lauryl alcohol, myristyl alcohol, cetyl alcohol, stearyl alcohol, erucyl alcohol, ricinol alcohol, isostearyl alcohol, arachidyl alcohol, behenyl alcohol, brassidyl alcohol as well as their guerbet alcohols. Further, it is possible to use fatty alcohol mixtures obtained by the reduction of naturally occurring fats and oils, such as beef tallow, peanut oil, rape oil, cotton seed oil, soy oil, sunflower oil, palm kernel oil, linseed oil, castor oil, corn oil, sesame oil, cocoa butter and coco oil. However, it is also possible to use synthetic alcohols such as the linear, even-numbered fatty alcohols obtained by Ziegler synthesis (Alfole®) or the partially branched alcohols by oxosynthesis (Dobanole®).

1.7. Additives (Optional)

Optionally, the lotion composition may contain up to 10% by weight, in particular 0.1 to 5% by weight additives, such as Preservatives which stabilize the lotion composition, such as methylisothiazolin(on) which may have a chlorine as substituent, e.g. 5-chloro-2-methyl-4-isothiazolin-3-on or 2-methyl-4-isothiazolin-3-on; phenoxyethanol or PHB ester, paraben preservatives, pentanediol, sorbic acid or other compounds as mentioned in "Kosmetikverordnung, Anlage 4, Teil A und B".

Germicidal agent(s), e.g. those described in DE-199 06 081 A.

Cosmetic agents, preferably from natural sources (plant extracts), having for instance a skin-soothing, antiphlogistic (reduction of skin irritation), wound-healing, cell-regenerating, anti-inflammatory and/or anti-itch effect such as allantoin; aloe vera extract; chamomile extract containing azulene and α-bisabolol; echinacea; dragosantanol; panthenol; liquorice root extract containing 18-glycyrrhetinic acid; lime tree extract containing quercetin and/or glyco-rutin; marigold (calendula oil); urea; phytosterols, optionally ethoxylated (available from Henkel under the tradename "Generol"); chitosan (acetylated chitin); anthocyanidins; gingko leaf extract containing quercetin and rutin; horse chestnut containing quercetin and campherol; vitamins or provitamins such as provitamin B5 or Vitamin E; avocado oil; birch extract; arnica; extract of rose of Sharon or St. John's wort; teatree oil; cucumber, hops, or hamamelis extracts or ingredients, ethoxylated quaternary amines (itching inhibiter useful for lotioned toilet papers); the use of α-bisabolol being preferred;

Perfume e.g. those described in DE 199 06 081; and/or

Cosmetically useful Dyes and pigments, e.g. those described in "Kosmetische Färbemittel" (Cosmetic Colouring Agents), published by the Farbstoffkommission der Deutschen Farbstoff-gemeinschaft; Verlag Chemie, Weinheim, 1984, p. 81–106.

The above additives may be used separately or in combination.

1.8. Most Preferred Lotion

The most preferred lotion composition, which based on current knowledge reflects the best mode for carrying out the invention, comprises the following components:

(A') 20 to 40 weight % of a liquid dialk(en)yl carbonate derived from C6 to C22 fatty alcohols (A") 20 to 40 weight % of a liquid glyceride wherein glycerol is esterified with at least one acid having from 6 to 24 carbon atoms, (B') 1 to 15 weight % of at least one alkyl-(oligo) glycoside.

(B") 2 to 15 weight % of a polyol polyester wherein a polyhydric alcohol having at least two hydroxy groups is esterified with at least one acid having from 6 to 30 carbon atoms and at least one hydroxy group or condensation product(s) of this hydroxy fatty acid, (C) 15 to 25 weight % water, (D) 1 to 10 weight % humectant, (E) optionally 1 to 5 weight % of at least one consistency regulator, (F) optionally 0.1 to 5 weight % additives.

2. Preparation of Lotion

The lotion composition (oil-in-water emulsion) can be prepared according to known methods (see for instance Karlheinz Schrader, *Grundlagen und Rezepturen der Kosmetika*, Hüthig Buch Verlag Heidelberg, Second Edition, 1989, pages 906 to 912).

One (low temperature) procedure which is only applicable if there are no solid components requiring melting for even distribution/dissolution involves mixing and homogeneously stirring the oil phase component(s), such as oil components (A) and emulsifier(s) (B) and other optional oil-phase components at room temperature (usually for approximately 10 min). The components of the water phase such as water, humectant, and possible water-soluble or water-dispersible additives such as perfume or preservatives are separately mixed at room temperature and slowly added to the mixture of oil-phase components during continuous stirring. After continued stirring (preferably for approximately 10 min) the resulting mixture is then homogenized (usually for approximately 10 min) with a suitable dispersion device such as supraton or stator-rotor homogenizers of the Ultraturrax type. As known from the prior art, homogenizing conditions may have an impact on the viscosity of the emulsion obtained. According to one embodiment, which is applicable, if solid components such as Cutina® MD require an increased temperature to be evenly distributed/dissolved in the oil phase, the lotion composition is prepared by mixing the oil phase and water phase components at a higher temperature. For this purpose, it is preferred to heat the oil phase and water phase components separately to about 80° C. to 85° C. Then, at this temperature the water phase components are slowly added to the oil phase components while stirring, optionally homnogenizing. After continued stirring, preferably for about 5 min, the mixture is allowed to cool while stirring in such a way that it remains in continuous motion. Simultaneously, the incorporation of air should be avoided. The mixture can then be homogenized with a suitable dispersion device such as supraton or stator-rotor homogenizers of Ultraturrax type, preferably at 60° to 65° C., in order to improve stability and structure. After a homogeneous state is reached, the composition is allowed to cool to room temperature.

If the viscosity is too high, it is possible for instance to reduce the energy influx during homogenization, in particular by lowering the rotational speed of the rotor/stator system.

3. Fibrous Web to be Treated

The term "fibrous web" is understood to be a planar fiber-based substrate. It may be one-ply or multi-ply. Its web structure makes it porous and absorptive for liquids such an water. Its basis weight preferably ranges from 10 to 100 $g/m^2$.

Preferably the web contains as main component (in particular at least 80% by weight, relative to the dry weight of the fibrous web, without lotion) cellulosic fibres, in particular pulp, although a proportional use of modified pulp fibers (e.g. from 10 to 50 weight %, relative to the total weight of the fibers) or the use of synthetic fibers suitable for web making (e.g. from 10 to 30% by weight, relative to the total weight of the fibers) is covered by the invention.

The "fibrous web" may be a "nonwoven" or a "tissue paper", the latter being preferred.

The German terms "Vlies" and "Vliesstoffe" are applied to a wide range of products which in terms of their properties are located between the groups, paper, paperboard, and cardboard on the one hand, and textile products on the other, and are currently summarized under the term "nonwovens" (see ISO 9092-EN 29092). The invention allows the application of known processes for producing nonwovens such as what are called air-laid and spun-laid techniques, as well as wet-laid techniques.

Nonwovens may also be called textile-like composite materials, which represent flexible porous fabrics that are not produced by the classic methods of weaving warp and weft or by looping, but by intertwining and/or by cohesive and/or adhesive bonding of fibers which may for example be present in the form of endless fibers or prefabricated fibers of a finite length, as synthetic fibers produced in situ or in the form of staple fibers. The nonwovens according to the invention may thus consist of mixtures of synthetic fibers in the form of staple fibers and pulp.

If the web is made of "tissue", creped or "uncreped" tissue paper obtained by wet rush transfer as described in the section "Background Art" can be lotioned, the use of creped tissue paper being preferred. The tissue paper (or the final tissue paper product obtained therefrom) can be single-ply or multi-ply (typically 2 to 6). The penetration behaviour of a low viscosity lotion can be particular suitable for multi-ply tissues (or tissue products), in particular 4-ply embodiments as used in toilet paper or handkerchiefs, since the lotion can be almost evenly distributed over the outer and inner plies.

The tissue paper may be homogeneous or layered, wet-pressed or blow-dried (TAD-dried). The tissue paper includes, but is not limited to, felt-pressed tissue paper, pattern-densified tissue paper, uncompacted tissue paper or compacted tissue paper.

The starting material for the production of the tissue paper usually is a fibrous cellulosic material, in particular pulp. If, however, linters or cotton is used as raw material for the production of tissue paper, usually no further pulping steps are needed. Due to the morphological structure, the cellulose already exists in an open state.

The starting pulps used may relate to primary fibrous materials (raw pulps) or to secondary fibrous materials, whereby a secondary fibrous material is defined as a fibrous raw material recovered from a recycling process. The primary fibrous materials may relate both to a chemically digested pulp and to mechanical pulp such as thermorefiner mechanical pulp (TMP), chemothermorefiner mechanical pulp (CTMP) or high temperature chemithermomechanical pulp (HTCTMP). Synthetic cellulose-containing fibres can also be used. Preference is nevertheless given to the use of pulp from plant material, particularly wood-forming plants. Fibers of softwood (usually originating from conifers), hardwood (usually originating from deciduous trees) or from cotton linters can be used for example. Fibres from esparto (alfa) grass, bagasse (cereal straws, rice straw, bamboo, hemp), kemp fibers, flax, and other woody and cellulosic fiber sources can also be used as raw materials. The corresponding fiber source is chosen in accordance with the desired properties of the end product in a manner known from the prior art. For example, the fibers present in hardwood, which are shorter than those of softwood, lend the final product a higher stability on account of the higher diameter/length ratio. If softness of the product is to be promoted, which is important e.g. for tissue paper, eucalyptus wood is particularly suitable as a fiber source.

With regard to softness of the products, the use of chemical raw pulps is also preferred, whereby it is possible to use completely bleached, partially bleached, and unbleached fibers. The chemical raw pulps suitable according to the invention include inter alia, sulphite pulps, kraft pulps (sulphate process).

Before a raw pulp is used in the tissue making process, it may also be advantageous to allow further delignification to occur in a separate process step or employ a bleaching process to achieve a more extensive removal of lignin after the cooking process and to obtain a completely cooked pulp.

A preferred production process for tissue paper uses a a forming section (for wet-laying a slurry of cellulosic fibrous material, typically pulp) comprising a headbox and wire portion, and b the drying section (TAD (through air drying) or conventional drying on the yankee cylinder) that also usually includes the crepe process essential for tissues.

This is typically followed by c the monitoring and winding area.

The tissue paper can be formed by placing the fibers, in an oriented or random manner, on one or between two continuously revolving wires of a paper-making machine while simultaneously removing the main quantity of water of dilution until dry-solid contents of usually between 12 and 35% are obtained. It is possible to include additives in the paper furnish to improve the wet-strength or dry-strength or other properties of the finished tissue paper.

Drying the formed primary fibrous web occurs in one or more steps by mechanical and thermal means until a final dry-solids content of usually about 93 to 97% is obtained. In the case of tissue making, this stage is followed by the crepe process which crucially influences the properties of the finished tissue product in conventional processes. The conventional dry crepe process involves creping on a drying cylinder having a diameter of usually 4.5 to 6 m , the so-called yankee cylinder, by means of a crepe doctor with the aforementioned final dry-solids content of the base ("raw tissue") tissue paper (wet creping can be used it lower demands are made of the tissue quality). The creped, finally dry base tissue paper is then available for further processing into the paper product or tissue paper product according to the invention.

Instead of the conventional tissue making process described above, the invention gives preference to the use of a modified technique in which an improvement in specific volume is achieved by a special kind of drying within process section b and in this way an improvement in bulk softness of the resulting tissue paper is achieved. This pre-drying process, which exists in a variety of subtypes, is termed the TAD (through air drying) technique. It is characterized by the fact that the "primary" fibrous web (like a non-woven) that leaves the sheet making stage is pre-dried to a dry-solids content of about 80% before final contact drying on the yankee cylinder by blowing hot air through the fibrous web. The fibrous web is supported by an air-permeable wire or belt and during its transport is guided over the surface of an air-permeable rotating cylinder drum. Structuring the supporting imprinting fabric or belt makes it possible to produce any pattern of compressed and uncompressed zones achieved by deflection of the fibres in the moist state, followed by pre-drying (TAP step) and leading the web through a pressure nip between a pressure roll and the Yankee cylinder surface, thereby resulting in increased mean specific volumes and consequently leading to an increase in bulk softness without decisively decreasing the strength of the fibrous web.

Another possible influence on softness and strength of base tissue lies in the production of a layering in which the primary fibrous web to be formed is built up by a specially constructed headbox in the form of physically different layers of fibrous material, these layers being jointly supplied as a pulp jet to the forming stage.

The one-ply intermediate products originating from the paper-making machine and lade of lightweight paper usually dry-creped on a yankee cylinder by means of a crepe doctor are generally described as "tissue paper" or more accurately base tissue paper. The one-ply base tissue may be built up of one or a plurality of layers respectively.

All one-ply or multi-ply final products made of base tissue and tailored to the end user's needs, i.e. manufactured with a wide variety of requirements in mind, are known as "tissue products".

When processing the fibrous web or base tissue paper into the final tissue product, the following procedural steps are normally used individually or in combination: cutting to size (longitudinally and/or cross cutting), producing a plurality of plies, producing mechanical and/or chemical ply adhesion, volumetric and structural embossing, folding, imprinting, perforating, application of lotions, smoothing, stacking, rolling up.

To produce multi-ply tissue paper products, such as handkerchiefs, toilet paper, towels or kitchen towels, an intermediate step preferably occurs with so-called doubling in which the base tissue in the finished product's desired number of plies is usually gathered on a common multiply master roll.

The processing step from the base tissue that has already been optionally wound up in several plies to the finished tissue product occurs in processing machines which include operations such as repeated smoothing of the tissue, edge embossing, to an extent combined with full area and/or local application of adhesive to produce ply adhesion of the individual plies (base tissue) to be combined together, as well as longitudinal cut, folding, cross cut, placement and bringing together a plurality of individual tissues and their packaging as well as bringing them together to form larger surrounding packaging or bundles. The individual paper ply webs can also be pre-embossed and then combined in a roll gap according to the foot-to-foot or nested methods.

Embossing can be used for generating ply adhesion in multi-ply tissue papers. In order to ensure that the lotion does not lower the ply adhesion, the embossed regions may be left untreated. Further it is known from U.S. Pat. No. 4,867,831 to use melted thermoplastics to achieve plybonding in lotioned tissue papers.

Tissue products using the lotioned tissue of the invention are preferably sanitary products (in particular toilet paper), paper handkerchiefs, cosmetic wipes (facials) or serviettes/napkins. The use in toilet paper having preferably 2 to 4 plies is particularly preferred.

According to the invention the tissue paper to be treated with the lotion preferably has a basis weight of 10 to 40, more preferably 12 to 20 g/m$^2$ per ply, in particular 13 to 17 g/m$^2$ and a total basis weight (including all plies without lotion) of usually 10 to 80 g/m$^2$.

4. Application of Lotion on the Web, in Particular Tissue Paper

As mentioned, lotion application typically takes place after the (paper) web has been dried. A suitable point in time is for example directly after drying the web, shortly before combining the webs to form multiple plies or before forming the multi-ply web into the final tissue product. However, it is preferred first to laminate at least two single ply webs to a multiply web, followed by application of lotion. For tissue paper having two or more plies, the lotion composition may be applied to each ply or only to one or both outer plies. In a preferred production process for lotioned 4-ply (products), two 2-ply webs are each lotioned on only one side, followed by joining together the untreated sides of said 2-ply webs, thereby obtaining a 4 ply product. It can be preferred to apply the lotion opposition to at least one, preferably both outer plies of multi-ply (tissue) webs, since then the advantageous penetration behavior of a low viscosity lotion composition can fully be developed by achieving a distribution as even as possible with respect to the z-direction (perpendicular) of the multi-ply web, in particular tissue paper. The individual plies or the multi-ply structure may be patterned either before or after application of the lotion composition. Suitable application techniques include spraying, rotogravure printing or flexographic printing or application by means of rolls having a smooth surface. Preferably, the lotion composition is slightly heated, in particular to a temperature from 30° to 50° C., before it is applied to the web.

Preferably, the lotion is applied in an amount of 3 to 10 g per m$^2$ treated surface, i.e. with the double the amount, if both surfaces are lotioned. The weight ratio lotion composition/web (single or multi-ply, dry weight) is preferably 5 to 30%, more preferably 9 to 25% by weight.

5. Test Method

The capacity of a lotioned tissue paper to sink in water was determined in line with the European Prenorm prENV 12625-8 "Tissue Paper and tissue products-Part 8: Determination of water absorption tame and water absorption capacity (manual and automated test method)", version for decision at the CEN/TC 172 meeting on Jun. 14, 2000, as follows:

The principle on which the prenorm is based involves progressively immersing a test piece of the tissue product by allowing it to come into contact with water.

The time required for complete wetting of the test piece (water absorption time) is determined and taken as measure for the sinking behaviour in water. The measurement of the water absorption time (manual version) was performed as follows, Test pieces shall be selected in accordance with ENV 12625-2.

Five test pieces shall be taken from the sample.

The test pieces are cut in machine direction (76±1) mm wide and of sufficient length to have 5 stacks of (5.0±0.2) g, and the weight of each ($M_O$) is reported.

Stacks are to be prepared comprising a number of sheets superimposed with all individual pieces having the same face up.

If several sheets are cut at once, it is essential to dissociate them before testing.

Condition the test pieces in accordance with ENV 12625-2.

Water container must be large enough for the basket to be submerged lying on its side (appropriate capacity: 3 liters). Fill it with sufficient demineralized water to have 100 mm depth. Liquid must be at room temperature.

As draining equipment a cylindrical metal wire basket as shown in FIG. 1 is to be used. The height and the diameter are constructed of suitable gauge wire to weigh (3±0.1) g. Solders or electric fusion should be used to create a firm structure. If using solders, they are to be distributed symmetrically in order to maintain the balance of the basket. One can compensate for the weight of the bottom by partially doubling one of the rings. Its weight ($M_b$) is recorded.

Each weighed test piece is to be rolled into a loose roll of about the same diameter as that of the cylindrical basket. The test piece is placed in the basket, loosely packed, (particularly avoiding any hand pressure), with its 76 mm edge parallel to the side of the basket and gently spread using fingers so that it molds itself to the contours of the basket (when using squares, place the stack in the basket, do not roll).

The basket is to be dropped on its side from a height of (25±5) mm above the water surface into the container of water and simultaneously timing is to be started.

Record the time required for complete wetting of the test piece. It means that the stopwatch must be stopped as soon as the test piece is completely submerged, Repeat this procedure four times with the remaining samples.

Calculate the mean water absorption time in seconds from the 5 values taken.

A lotion composition containing the following ingredients was prepared at increased temperature as described above:

TABLE 1

| Component | % by weight |
|---|---|
| Polyglyceryl poly(12-hydroxy stearate) (PGPH) | 5.3 |
| Lauryl glucoside | 5.3 |
| Glyceryl stearate (Cutina ® MD)[1] | 3.0 |
| Cocoglyceride (Myritol ® 331)[1] | 30.0 |
| Di-n-octyl carbonate (Cetiol ® CC)[1] | 30.0 |
| Citric acid[3] | 0.1 |

TABLE 1-continued

| Component | % by weight |
|---|---|
| Bisabolol | 1.5 |
| Glycerol | 4.0 |
| Perfume | 0.35 |
| Phenonip ®[2] | 1.0 |
| Water | ad 100 |

[1]available from Cognis Deutschland GmbH
[2]Phenonip ® is a commercially available preservative mixture (from Clariant Deutschland) and contains phenoxyethanol as well as methyl-, ethyl-, propyl- and butylparaben.
[3]Citric acid is present for pH adjustment in the commercially available (from Cognis Deutschland GmbH) emulsifier combination Eumulgin ® VL 75 (based on PGPH, Laurylglucoside, glycerol and water) which was used for preparing the lotion.

The lotion composition has a viscosity of about 3000 mPa·s at 23° C. (measured with a Brookfield-RVF viscosimeter, spindle 5, 10 rpm). Conductivity measurements showed that the above lotion is of O/W type.

This lotion composition was heated to about 40° C. and applied with a rotogravure device on one side of two 2-ply webs in an amount of 7 g/m$^2$ each. Then the untreated side of one 2-ply web was partially coated with adhesive (cold glue or hotmelt) and then joined together in face to face relationship with the untreated side of the other 2-ply web, thereby obtaining a 4 ply web having lotion on both outer sides (total amount of lotion 14 g/m$^2$). The corresponding, but untreated 4-ply web showed a basis weight of 66.8 g/m$^2$ and a thickness of 0.49 mm, and a bulk of 7.3 cm$^3$/g. This leads to an amount of about 21% by weight lotion based on the weight of the four-ply tissue.

The sinking behaviour in water (water absorption time) of this lotioned tissue paper was determined in accordance with the prENV 12625-8 as described above. The water absorption time was about 3 s.

As comparative example, lotioned 4-ply tissue papers were produced in line with EP 1 029 977 A. The corresponding lotions are of W/O type and contain major parts of oil and wax components. Their water absorption time was typically more than 1 h. Undesirably long water absorption times in the same order were also observed for commercially available lotioned facials ("Kleenex Balsam" produced by Kimberley Clark, "Puffs Plus" produced by Procter & Gamble) where the lotion is water-free.

The lotioned tissue paper of the invention further showed an excellent surface softness and in particular bulk softness. Simultaneously, it was capable of efficiently transferring lotion to the skin of the user.

What is claimed is:

1. Fibrous web treated with a lotion composition based on an oil-in-water emulsion comprising (A) at least one oil component comprising a mixture of at least one liquid oil (A') selected from symmetric or asymmetric dialk(en)ylethers having from 6 to 24 C atoms (per alk(en)yl group) and linear or branched dialk(en)ylcarbonates derived from C6 to 22 fatty alcohols and at least one liquid oil (A") selected from waxy esters, glycerides, natural oils and hydrocarbon based oils, (B) an oil-in-water emulsifier or oil-in-water emulsifier combination, and (C) 6 to 35 weight % of water, based on the total weight of the lotion composition;

wherein the treated fibrous web has a water absorption time of less than one minute.

2. The fibrous web according to claim 1, wherein the lotion comprises (A) 20 to 70 weight % of said at least one oil component, (B) 3 to 40 weight % of said oil-in-water emulsifier or oil-in-water emulsifier combination, and (C) 6 to 35 weight % of water, wherein the weight % values relate to the total weight of the lotion composition.

3. The fibrous web according to claim 1, wherein the oil-in-water emulsifier combination comprises (B') at least one alkyl(oligo)glycoside having optionally alkoxy units, and (B") at least one polyol polyester wherein a polyhydric alcohol having at least two hydroxy groups is esterified with at least one acid having from 6 to 30 carbon atoms and at least one hydroxy group, or condensation product(s) of this hydroxy fatty acid.

4. The fibrous web according to claim 3, wherein said polyol polyester (B") is polyglyceride poly (12-hydroxystearate).

5. The fibrous web according to claim 1, wherein the lotion composition further comprises at least one humectant (D) in an amount of 1 to 15 weight %.

6. The fibrous web according to claim 1, wherein the at least one liquid oil (A') has a viscosity lower than 30 mPa·s measured with a Höppler falling sphere viscosimeter at 20°C.

7. The fibrous web according to claim 1, wherein the at least one liquid oil (A") has a viscosity greater than 30 mPa·s and not more than 100 mPa·s measured with a Höppler falling sphere viscosimeter at 20° C.

8. The fibrous web according to claim 1, wherein the lotion composition comprises:

(A') 20 to 40 weight % of a liquid dialk(en)yl carbonate derived from C6 to C22 fatty alcohols, (A") 20 to 40 weight % of a liquid glyceride wherein glycerol is esterified with at least one acid having from 6 to 24 carbon atoms, (B') 1 to 15 weight % of at least one alkyl (oligo) glycoside, (B") 2 to 15 weight % of a polyol polyester wherein a polyhydric alcohol having at least two hydroxy groups is esteritied with at least one acid having from 6 to 30 carbon atoms and at least one hydroxy group or condensation product(s) of this hydroxy fatty acid, (C) 15 to 25 weight % water, (D) 1 to 10 weight % humectant, (E) optionally 1 to 5 weight % of at least one consistency regulator, and (F) optionally 0.1 to 5 weight % additives.

9. The fibrous web according to claim 1, wherein the fibrous web is a single ply or multi ply tissue paper.

10. The fibrous web according to claim 1, wherein the fibrous web is a toilet paper having from 2 to 4 plies.

* * * * *